US007651289B2

(12) United States Patent
Bahbahani

(10) Patent No.: US 7,651,289 B2
(45) Date of Patent: Jan. 26, 2010

(54) WRITING INSTRUMENT

(76) Inventor: Nehad Bahbahani, P.O. Box 2943, Safat - 13030 (KW)

( * ) Notice: Subject to any disclaimer, the term of this patent is extended or adjusted under 35 U.S.C. 154(b) by 697 days.

(21) Appl. No.: 11/370,923

(22) Filed: Mar. 9, 2006

(65) Prior Publication Data

US 2007/0231049 A1 Oct. 4, 2007

(51) Int. Cl.

| | |
|---|---|
| ***B43K 21/00*** | (2006.01) |
| ***B43K 21/02*** | (2006.01) |
| ***A45D 40/04*** | (2006.01) |
| ***A45D 40/06*** | (2006.01) |

(52) U.S. Cl. ..... 401/84; 401/54; 401/74; 401/80; 401/87

(58) Field of Classification Search ..... 401/54, 401/67–69, 80–82, 52, 74, 84, 87
See application file for complete search history.

(56) References Cited

U.S. PATENT DOCUMENTS 2,055,316 A * 9/1936 Sharrow ..... 401/54
5,423,623 A * 6/1995 Bakic ..... 401/70

* cited by examiner

*Primary Examiner*—David J. Walczak
*Assistant Examiner*—Ryan A Varnum
(74) *Attorney, Agent, or Firm*—Lowe Hauptman Ham & Berner, LLP

(57) ABSTRACT

An adjustable pencil for varying the pressure on a piece of lead includes a cylindrical barrel, and a guide tube containing a piece of lead disposed in the barrel. A coil spring, a rectangular channel with a plurality of stops and a follower compresses the spring for increasing or decreasing the longitudinal force applied to the lead as it engages a writing surface. A knob rotates the guide tube to open or close a pair of jaw like grips for maintaining a pre-selected length of lead extending from the tip of the pencil.

2 Claims, 4 Drawing Sheets

WRITING INSTRUMENT

FIELD OF THE INVENTION

This invention relates to a writing instrument and more particularly to an adjustable pencil for varying the pressure on a piece of writing material.

BACKGROUND FOR THE INVENTION

Mechanical pencils are well known. For example, such pencils typically include a barrel, a lead feeding mechanism disposed in the barrel and a lead holder disposed in the tip of the lead feeding mechanism to hold the lead penetrating therethrough and an operating part to feed the lead.

For example, a mechanical pencil including a barrel, a lead feeding mechanism disposed in the barrel to tighten and feed a piece of lead and a lead holder disposed between the lead feeding mechanism and a tip end of the barrel is disclosed in a U.S. Pat. No. 6,908,246 of Kageyama et al. As disclosed therein, the lead holder includes a through hole through which the lead penetrates, holding portions for holding the lead, and a contact portion for contacting an inner peripheral face of the barrel. The holding portion includes a first holding portion at a first position of the lead holder and a second holding portion at a rear portion of the lead holder. When a length of lead becomes shorter than a distance between the lead feeding mechanism and the end of the barrel, the first holding part holds the short lead and the second holding portion holds a next piece of lead.

Mechanical pencils of the above type have been used and serve the needs of an average individual. However, such pencils do not adequately serve the needs of some artists. The problem is that artists frequently use various types of pencils in making sketches and frequently include pencils of different hardness in their writing supplies and/or writing cases. However, there are times when an artist does not have his or her supplies at hand and yet would like to have a pencil with leads of different hardness. For this reason, it is believed that there may be a demand for an improved writing instrument in accordance with the present invention. There should be a demand because such pencils include a single piece of lead and at the same time provide the characteristics of a multi-hardness pencil.

Further, the writing instrument in accordance with the present invention includes replaceable leads, has a minimum number of parts, and is durable, easy to use and easy to select a pre-selected force on a lead. Such instruments can also be manufactured and sold at a relatively low cost and provide an artist as well as a relatively untrained or new artist an ability to select different effects from a single piece of lead of a single hardness.

BRIEF SUMMARY OF THE INVENTION

In essence the present invention contemplates an adjustable pencil for varying the pressure on a piece of writing material as for example a piece of lead. The invention includes an elongated barrel having a longitudinal axis and a longitudinal passageway extending through the barrel. The barrel also includes a forward portion, a tip at the forward end of the forward portion and a rear portion. The writing instrument also includes a replaceable rod shaped piece of writing material such as an ordinary piece of lead disposed in the passageway and extending outwardly from the tip by a predetermined length. Means for advancing the piece of lead along the passageway and outwardly from the tip are provided. In addition, a coil spring for increasing and decreasing the force exerted by the spring on the piece of writing material is provided.

A preferred embodiment of the invention also includes a longitudinally extending generally rectangular channel in the cylindrical barrel with a plurality of generally perpendicular stops to maintain a force exerted on the lead by the coil spring on the piece of lead.

The invention also contemplates a method for obtaining multiple degrees of shading from a pencil with a writing material having a single hardness. The method includes the steps of providing an elongated cylindrical barrel with a longitudinally extending passageway extending through the barrel and a rod shaped piece of writing material such as a piece of lead disposed in the longitudinally extending passageway and extending outwardly from one end thereof. A pre-selected force is maintained on the lead by a coil spring and a longitudinally extending generally rectangular channel with a plurality of perpendicular stops. A follower within the longitudinally extending rectangular channel engages one of the stops to maintain the pre-selected force on the piece of writing material. The piece of writing material is then used to write or shade a line with a density based on the stop used to regulate the force exerted by the spring on the writing material.

The invention will now be described in connection with the accompanying figures wherein like numerals have been used to indicate like parts.

DESCRIPTION OF THE PREFERRED EMBODIMENTS OF THE INVENTION

Figure 1:
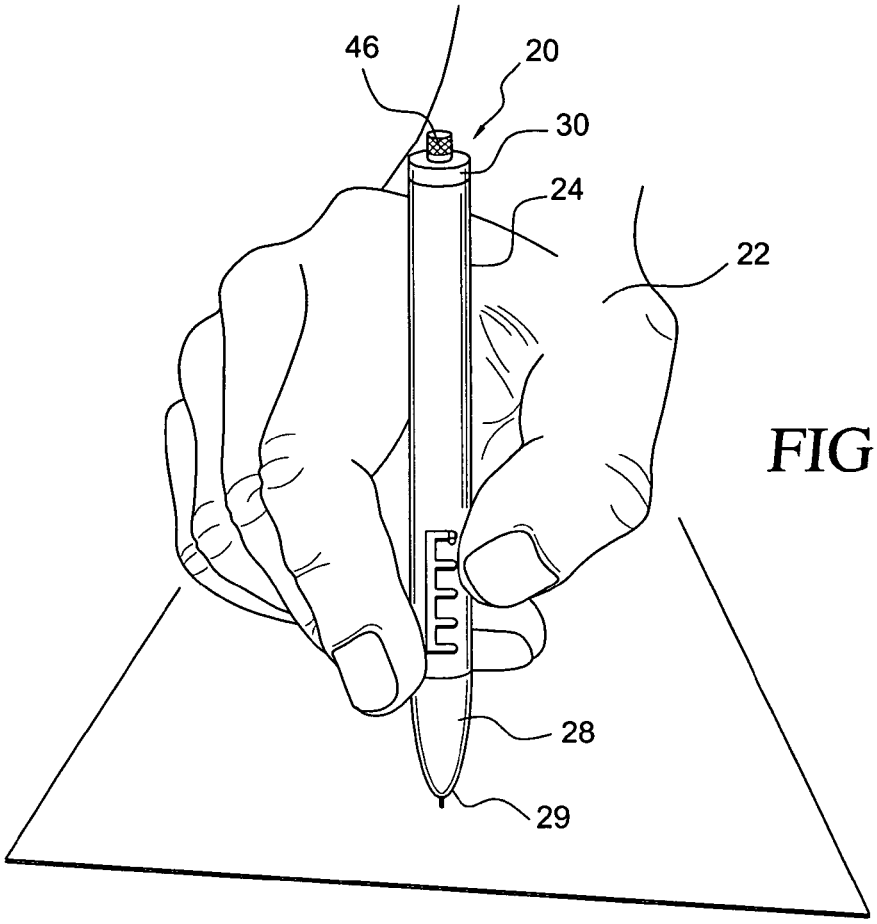
FIG. 1 is a perspective view illustrating a writing instrument in accordance with a preferred embodiment of the invention.

A writing instrument i.e. an adjustable pencil for varying the pressure on a piece of lead is shown in FIG. 1. As illustrated, an adjustable pencil 20 is held in the hand 22 of an individual in a conventional manner. The adjustable pencil 20 includes an elongated cylindrical barrel 24 having a longitudinal passageway 26 (See FIG. 4-7 and 9) extending through the passageway 26. The barrel 24 also includes a forward portion 28 and tip 29 at a forward end of the forward portion 28 and a rear portion 30.

Figure 2:
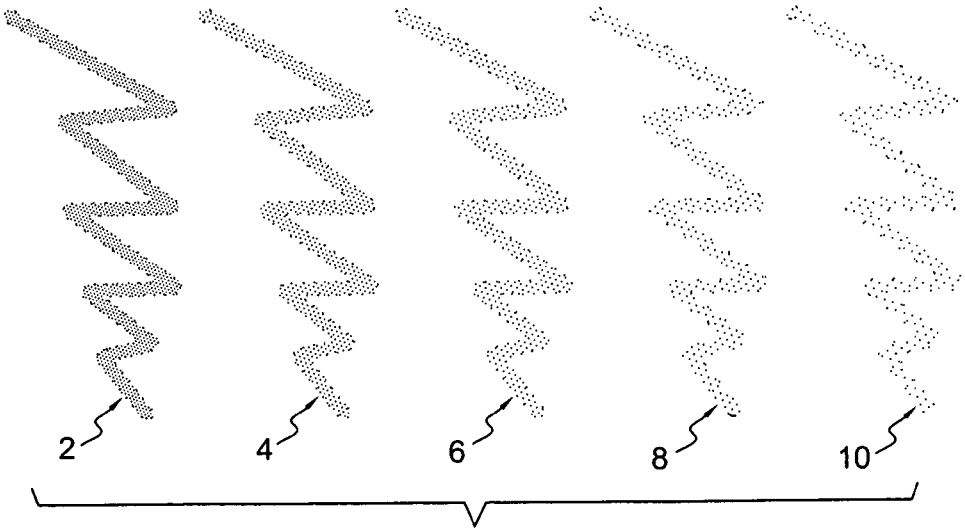
FIG. 2 is a schematic illustration of a plurality of marks made by a writing instrument in accordance with the invention.
Figure 3:
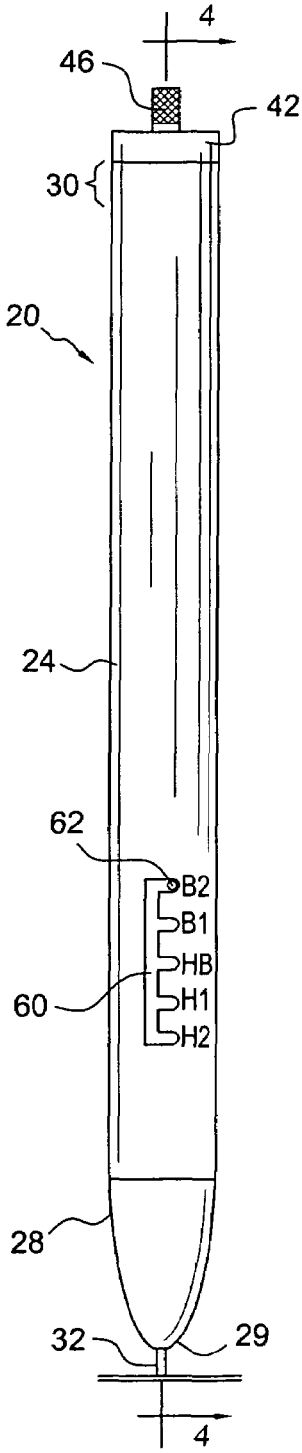
FIG. 3 is a side elevation view of the writing instrument in accordance with the preferred embodiment of the invention.

FIG. 2 illustrates the difference in density of a mark made with different settings, that is wherein various stops are used to increase or decrease the force applied by a coil spring 40 (FIGS. 4-7 and 9) on a relatively soft piece of lead. For example, the mark 2 has a relatively high density that corresponds to an H2 setting as shown in FIG. 3 while the mark 4 corresponds to an H1 setting. For contrast, the marks 6, 8 and 10 correspond to HB, B1 and B2 settings respectively.

Referring now to FIGS. 3-7 and 8, a replaceable rod like piece of lead 32 is disposed within a lead holder or tubular guide 34. The guide 34 is disposed within the barrel 24 and extends from the rear portion 30 to the forward portion 28 and has a standard diameter to accommodate a conventional piece of lead. A threaded end cap 42 having external threads is screwed into the rear portion 30 of the barrel 24 in a conventional manner as shown more clearly in FIG. 8. The forward portion 28 is threaded into an opposite end of the barrel 24 as shown more clearly in FIG. 9. In each case, the barrel 24 is internally threaded and adapted to receive the externally threaded portions of the end cap 42 and forward portion 28.

Figure 4:
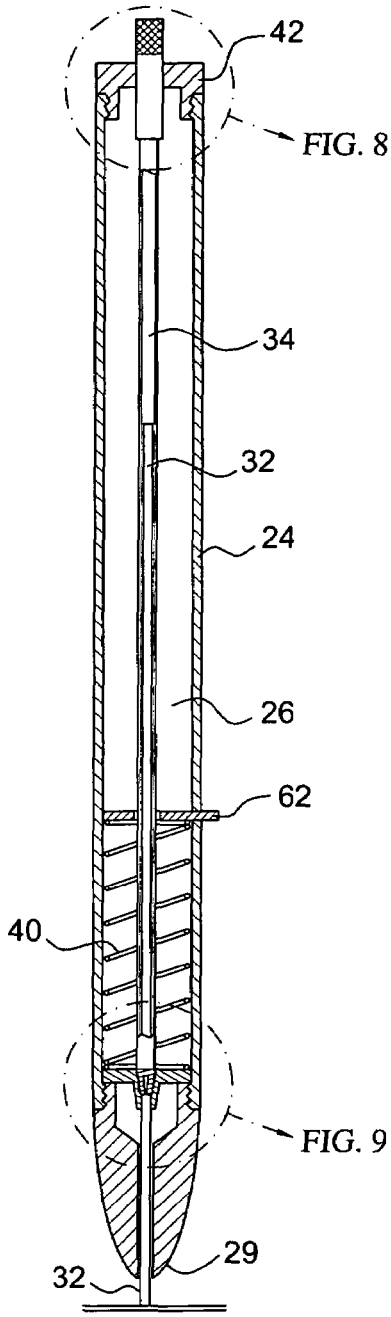
FIG. 4 is a cross-sectional view of the writing instrument shown in FIG. 3 but with a hardness setting at B2 as shown in FIG. 3.
Figure 8:
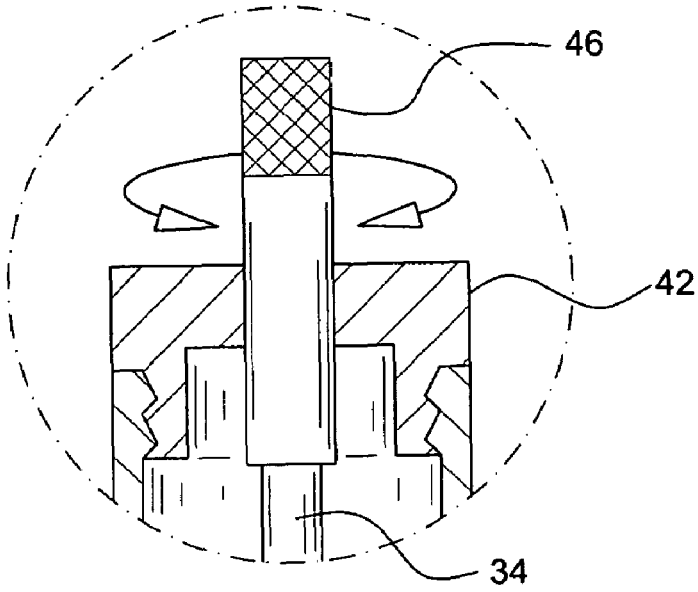
FIG. 8 is an enlarged cross-sectional view of the mechanism for releasing a grip on a piece of writing material.
Figure 9:
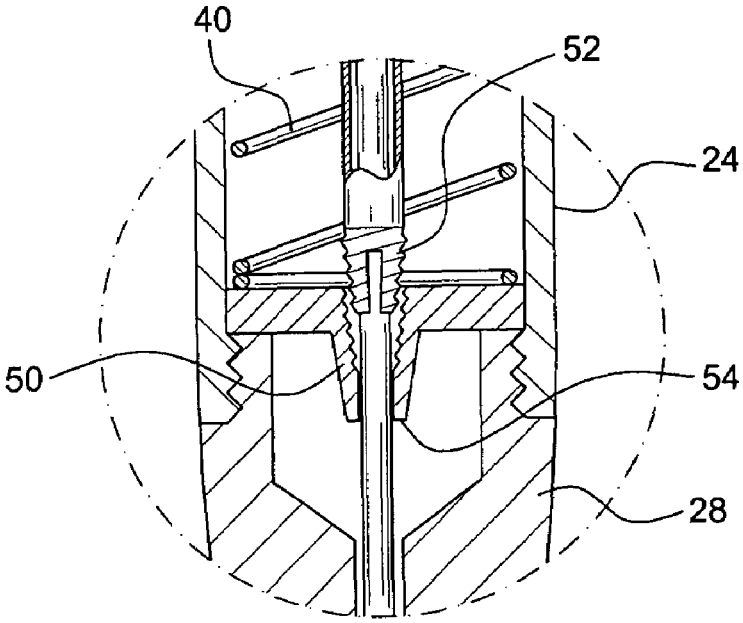
FIG. 9 is an enlarged cross-sectional view of the lead gripping mechanism in accordance with the present invention.

A knurled knob 46 extends outwardly through the end cap 42 and is fixed to one end of the tubular guide 34 as shown more clearly in FIG. 8. The knob 46 is rotatably disposed within the end cap 42 in a conventional manner and rotates the tubular guide 34 for tightening and loosing a grip member 50. As shown in FIG. 4 and 9, the tubular guide 34 includes a tapered threaded end 52(shown in FIG. 9) with external threads for engaging the internal threads of the grip member 50. Therefore, by turning the knurled knob 46 in a first direction into the internally threaded portion of the gripping member 50 opens the jaws 54 and releases the piece of lead 32 so that the lead 32 will tend to fall in or out of the tube 34 depending on the position of the pen. In this way, an individual can select the length of lead extending out of the tip 29 and turn the knob 46 to allow the jaws 54 to close on the lead 32 to fix the position of the lead 32.

Figure 5:
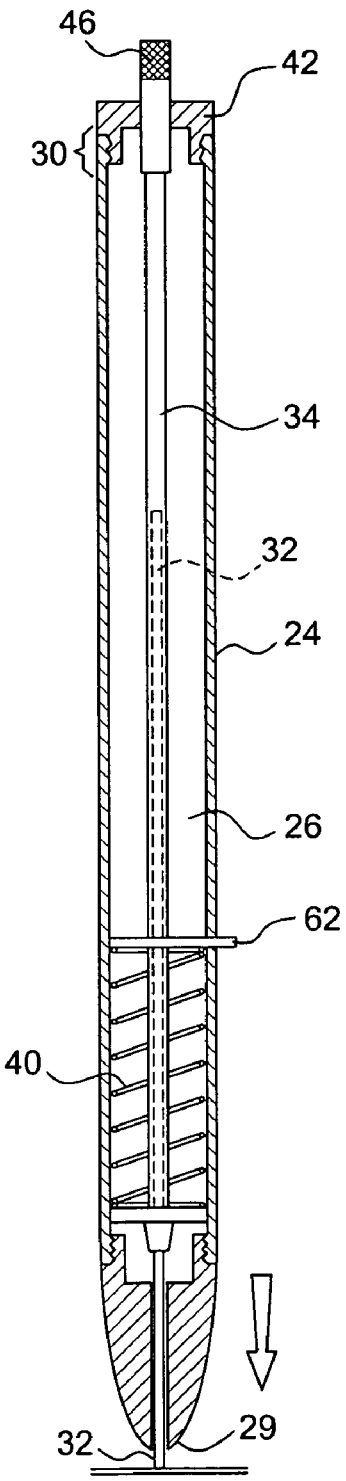
FIG. 5 is a cross-sectional view of the writing instrument shown in FIG. 3 but with the hardness setting at B1.
Figure 6:
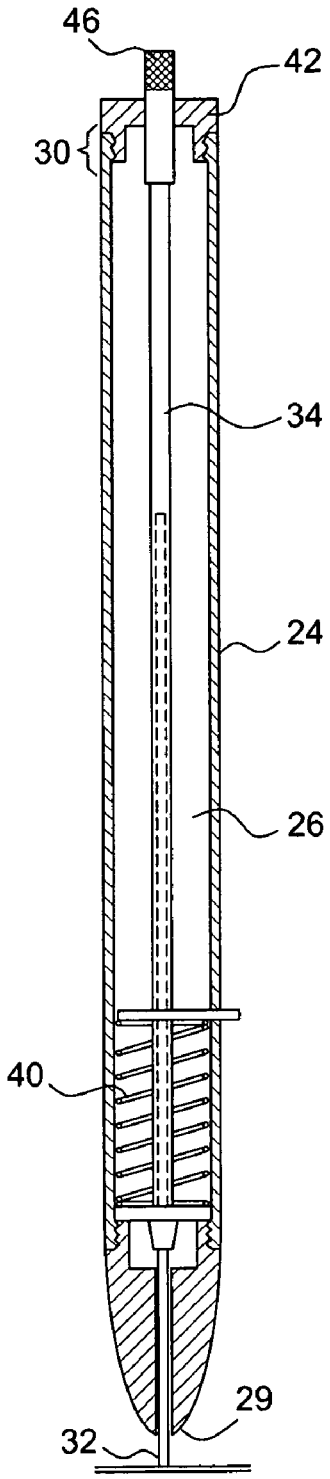
FIG. 6 is a cross-sectional view of the writing instrument shown in FIG. 3 but with the hardness setting at HB.
Figure 7:
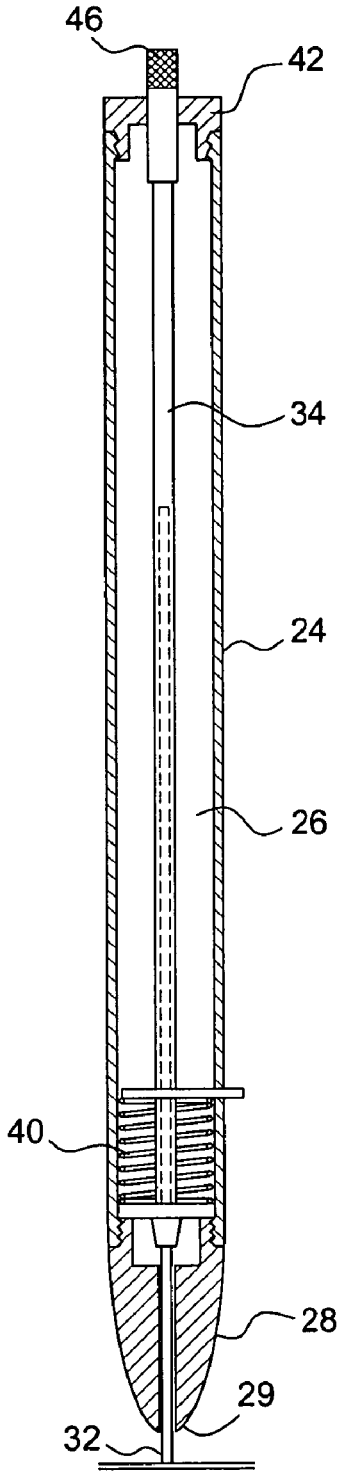
FIG. 7 is a cross-sectional view of the writing instrument shown in FIG. 3 but with the hardness setting at H2.

In the preferred embodiment of the invention, means for controlling the force exerted on a piece of lead includes the coil spring 40, a generally rectangular channel 60 and a plurality of perpendicular stops B2, B1, HB, H1 and H2 extending outwardly from the channel 60. A follower 62 extends through the channel 60 and slightly beyond for adjusting the force exerted by the spring 40 on the lead 32. For example, when the follower 62 engages the B2 stop as shown in FIG. 3, the spring 40 will be at its minimum compression and a relatively slight force will be applied to the lead 32. By comparison, when the follower 62 is placed in the H2 stop (FIG. 7) a maximum force is applied. Intermediate portions are shown in FIGS. 4-6. A method for obtaining multiple degrees of shading from a pencil with a single piece of lead having a single hardness includes the steps of providing an elongated cylindrical barrel having a tip at one end thereof, and a guide tube extending through the barrel and adapted to receive a piece of lead disposed therein. The method also includes placing a piece of lead in the guide tube with a portion thereof extending outwardly from the tip for writing on a surface and fixing the lead within the guide tube. In addition, the method includes providing a coil spring and a generally rectangular channel with a plurality of stops and a follower within the channel for increasing and decreasing the force applied on the piece of lead by the spring. Further, the method includes the steps of selecting a force to be applied to the lead and making marks on a surface with that force applied, and selecting a second force to be applied to the lead and making marks on a surface with the second force applied.

While the invention has been described in connection with its preferred embodiments it should be recognized that changes and modifications may be made therein without departing from the scope of the appended claims.

What is claimed is:

1. An adjustable pencil for varying the pressure on a piece of lead, said pencil comprising:

an elongated cylindrical barrel having a longitudinal axis and a longitudinal passageway extending through said barrel and said barrel including a forward portion, a tip at a forward end of said forward portion and a rear portion;

a rod shaped piece of lead writing material disposed in said passageway and extendable outwardly from said tip;

means for advancing and withdrawing said piece of lead along said passageway and outwardly from said tip;

said means for advancing and withdrawing said piece of lead writing material includes a gripping member having a tapered internal thread and a tapered screw member having a tapered external thread for engaging and disengaging said gripping member, said gripping member fixing said lead writing material in said passageway with a portion of lead writing material extending outwardly therefrom; and means including a coil spring, a longitudinally extending generally rectangular channel in said cylindrical barrel with a plurality of perpendicular stops and a follower within said channel and extending slightly therefrom for engaging said stops to thereby maintain a pre-selected force on said lead writing material.

2. An adjustable pencil for varying the pressure on a piece of lead according to claim 1 in which said means for advancing and withdrawing said piece of lead writing material includes a knob at an opposite end of said barrel for engaging and disengaging said gripping member.

* * * * *